US006220557B1

(12) United States Patent
Ziaylek et al.

(10) Patent No.: US 6,220,557 B1
(45) Date of Patent: Apr. 24, 2001

(54) MOUNTING BRACKET MEANS FOR DETACHABLY SUPPORTING A GENERALLY CYLINDRICALLY-SHAPED MEMBER UPON A WALL SURFACE

(75) Inventors: Michael P. Ziaylek, 15 Cold Spring Ave.; Theodore Ziaylek, Jr., 140 Riverview Dr., both of Yardley, PA (US) 19067

(73) Assignees: Michael P. Ziaylek; Theodore Ziaylek, Jr.; Theodore P. Ziaylek

( * ) Notice: Subject to any disclaimer, the term of this patent is extended or adjusted under 35 U.S.C. 154(b) by 0 days.

(21) Appl. No.: 09/407,144

(22) Filed: Sep. 28, 1999

(51) Int. Cl.[7] ..... A47G 1/10
(52) U.S. Cl. ..... 248/316.1; 248/154; 248/311.2
(58) Field of Search ..... 248/316.1, 313, 248/311.2, 154, 316.5, 229.16, 229.2, 229.26, 74.1

(56) References Cited

U.S. PATENT DOCUMENTS

| | | | |
|---|---|---|---|
| D. 222,527 | 11/1971 | Ziaylek, Jr. . | |
| D. 237,357 | 10/1975 | Ziaylek, Jr. . | |
| D. 244,392 | 5/1977 | Montambo . | |
| D. 245,929 | 9/1977 | Montambo . | |
| D. 267,227 | 12/1982 | Ziaylek, Jr. . | |
| D. 303,738 | 10/1989 | Ziaylek, Jr. . | |
| D. 314,325 | 2/1991 | Ziaylek, Jr. et al. . | |
| D. 319,778 | 9/1991 | Ziaylek, Jr. . | |
| D. 347,735 | 6/1994 | Ziaylek, Jr. et al. . | |
| D. 353,242 | 12/1994 | McCoy, Sr. et al. . | |
| 1,117,491 | 11/1914 | Hornung . | |
| 1,911,781 | 5/1933 | Wolfe, Jr. . | |
| 1,925,767 | 9/1933 | Mallory . | |
| 2,029,051 | 1/1936 | Blevins . | |
| 3,144,232 | 8/1964 | Smootz . | |
| 3,204,775 | 9/1965 | Smith et al. . | |
| 3,224,644 | 12/1965 | Davis . | |
| 3,603,550 | 9/1971 | Byrd . | |
| 3,765,635 | 10/1973 | Burrell et al. | 248/313 |
| 3,780,972 | 12/1973 | Brodersen | 248/313 |
| 4,023,761 | 5/1977 | Molis | 248/313 |
| 4,213,592 | 7/1980 | Lingenfelser . | |
| 4,391,377 | 7/1983 | Ziaylek, Jr. . | |
| 4,444,358 | 4/1984 | Spohn . | |
| 4,586,687 | 5/1986 | Ziaylek, Jr. | 248/313 |
| 4,606,521 | 8/1986 | Williams | 248/214 |
| 4,624,432 | 11/1986 | Salacuse | 248/316.5 |
| 4,828,211 | 5/1989 | McConnell et al. | 248/311.2 |
| 4,848,714 | 7/1989 | Ziaylek, Jr. et al | 248/313 |
| 5,297,890 * | 3/1994 | Commins | 248/74.1 X |
| 5,318,266 | 6/1994 | Liu | 248/311.2 |
| 5,362,022 * | 11/1994 | McLoughlin et al. | 248/313 |
| 5,423,508 | 6/1995 | Isenga et al. | 248/311.2 |
| 5,462,246 | 10/1995 | Schlenker | 248/49 |
| 5,607,133 | 3/1997 | Markham et al. | 248/313 |
| 5,833,195 | 11/1998 | Haynes | 248/316.5 |

* cited by examiner

*Primary Examiner*—Ramon O. Ramirez
(74) *Attorney, Agent, or Firm*—Sperry, Zoda & Kane

(57) ABSTRACT

A backing plate member is securable preferably to a vertically extending wall with at least one or more C-shaped clamping members secured thereto and extending outwardly therefrom approximately horizontally. Each clamping member includes a first and second clamp arm with a unique clamp arm adjustment means attached therebetween and positioned between the clamp base and the cylinder gripping zone defined between the clamp arms. The clamp arm adjustment means preferably includes a locking member for adjusting the spacing between the clamps for adjusting the size of the cylinder gripping zone as well as a spacer member with an arcuate abutment surface mated to the adjustment abutment surface of one of the clamp arms to facilitate contact therebetween at various adjustment positions and contact therebetween as the preferably flexibly resilient clamp arms are resiliently flexed to a more open position during urging of a cylindrically-shaped member therebetween into the cylinder gripping zone.

19 Claims, 2 Drawing Sheets

MOUNTING BRACKET MEANS FOR DETACHABLY SUPPORTING A GENERALLY CYLINDRICALLY-SHAPED MEMBER UPON A WALL SURFACE

BACKGROUND OF THE INVENTION

1. Field of the Invention

The present invention deals with the field of wall mounted brackets or retaining devices adapted to secure members thereto. More particularly the devices are designed to be securable specifically with respect to round members and, in particular, cylindrically-shaped members and as such require at least two clamping arms to define an area therebetween to facilitate holding of the otherwise difficult to grasp cylindrical or curved surface.

2. Description of the Prior Art

There are numerous design and utility patents which deal with the purpose of providing a means for mounting of generally cylindrically-shaped members upon a vertically extending surface and, in particular, a wall surface such as U.S. Pat. No. 1,117,491 patented Nov. 17, 1914 to E. Hornung on an "Umbrella Stand"; and U.S. Pat. No. 1,911, 781 patented May 30, 1933 to 0. P. Wolfe, Jr. on a "Support And Holder For Brooms, Mops, And The Like"; and U.S. Pat. No. 1,925,767 patented Sep. 5, 1933 to G. W. Mallory on a "Broom Holder"; and U. S. Pat. No. 2,029,051 patented Jan. 28, 1936 to A. C. Blevins and assigned to Nu-Deal Handle Co. on a "Bottle Holder"; and U.S. Pat. No. 3,144, 232 patented Aug. 11, 1964 to H. 0. Smootz on a "Torch Holder"; and U.S. Pat. No. 3,204,775 patented Sep. 7, 1965 to G. L. Smith et al on a "Support For Self-Contained Breathing Apparatus"; and U.S. Pat. No. 3,225,644 patented Dec. 28, 1965 to K. Schuch and assigned to VEB Carl Zeiss Jena on an "Apparatus Producing Interferential Test Data For Measuring And Control Instruments"; and U.S. Pat. No. 3,603,550 patented Sep. 7, 1971 to C. Byrd and assigned to Lacy J. Miller Machine Company, Inc. on a "Quick Release Support"; and U.S. Design Pat. No. Des. 222,527 patented Nov. 2, 1971 on a "Bracket For Use With Lifesaving Equipment"; and U.S. Pat. No. 3,765,635 patented Oct. 16, 1973 to W. R. Burrell et al and assigned to Burrell Bros., Inc. on a "Bracket For Gas Containers And Similar Tanks"; and U.S. Pat. No. 3,780,972 patented Dec. 25, 1973 to J. C. Brodersen on a "Mounting Apparatus For Gas Containers"; and U.S. Design Pat. No. Des. 237,357 patented Oct. 28, 1975 to T. Ziaylek, Jr. and assigned to Ziamatic Corporation on a "Tank Support Bracket For Lifesaving Equipment"; and U.S. Design Pat. No. Des. 244,392 patented May 17, 1977 to R. Montambo and assigned to The Ansul Company on a "Combined Fire Extinguisher And Bracket"; and U.S. Pat. No. 4,023,761 patented May 17, 1977 to J. Molis on an "Adjustable Bracket To Stabilize Upright Compressed Gas Containers Against Displacement On Mobile Vehicles And Ship-Board Installations And Maintenance Shops"; and U.S. Design Pat. No. Des. 245,929 patented Sep. 27, 1977 to R. Montambo and assigned to The Ansul Company on a "Fire Extinguisher Bracket"; and U.S. Pat. No. 4,213,592 patented Jul. 22, 1980 to D. Lingenfelser and assigned to Caterpillar Tractor Co. on a "Bracket Assembly For Mounting Fire Extinguishers Thereon"; and U.S. Design Pat. No. Des. 267,227 patented Dec. 14, 1982 to T. Ziaylek, Jr. and assigned to Ziamatic Corporation on a "Support Bracket For A Gas Cylinder"; and U.S Pat. No. 4,391,377 patented Jul. 5, 11983 to T. Ziaylek, Jr. on a "Knock-Down Assembly For Supporting Oxygen Tanks"; and U.S. Pat. No. 4,444,358 patented Apr. 24, 1984 to D. Spohn et al on a "Fluid Reservoir And Connector"; and U.S. Pat. No. 4,586,687 patented May 6, 1986 to T. Ziaylek, Jr. on an "Air Tank Support Of The Quick Release Type"; and U.S. Pat. No. 4,606,521 patented Aug. 19, 1986 to G. Williams on a "Cylinder Holder"; and U.S. Pat. No. 4,624,432 patented Nov. 25, 1986 to F. Salacuse and assigned to Super Glue Corporation on a "Heavy Duty Clamping System"; and U.S. Pat. No. 4,828,211 patented May 9, 1989 to D. McConnell et al and assigned to ITC, Incorporated on a "Foldable Support For Beverage Container"; and U.S. Pat. No. 4,848, 714 patented Jul. 18, 1989 to T. Ziaylek, Jr. et al on a "Mounting Plate With Rollers"; and U.S. Design Pat. No. Des. 303,738 patented Oct. 3, 1989 to T. Ziaylek, Jr. on a "Rotatable Cylinder Holder"; and U.S. Design Pat. No. Des. 314,325 patented Feb. 5, 1991 to T. Ziaylek, Jr. et al on a "Clamping Set Of Bracket Arms For Supporting Tubular Objects"; and U.S. Design Pat. No. Des. 319,778 patented Sep. 10, 1991 to T. Ziaylek, Jr. on a "Vertical Support Brace Bracket Panel For Holding Tubular Objects"; and U.S. Pat. No. 5,318,266 patented Jun. 7, 1994 to H. Liu on a "Drink Holder"; and U.S. Design Pat. No. Des. 347,735 patented Jun. 14, 1994 to T. Ziaylek, Jr. et al on a "Quick Release Support Tank Bracket"; and U.S. Design Pat. No. Des. 353,242 patented Dec. 6, 1994 to G. McCoy, Sr. et al on a "Paint Can Holder"; and U.S. Pat. No. 5,423,508 patented Jun. 13, 1995 to S. Isenga et al and assigned to ITC, Incorporated on a "Foldable Support For Beverage Container"; and U.S. Pat. No. 5,462,246 patented Oct. 31, 1995 to D. Schlenker on an "Anti-Rotation Clamp For Gated Irrigation Pipe"; and U.S. Pat. No. 5,607,133 patented Mar. 4, 1997 to H. Markham et al and assigned to E-Z Metal Products, Inc. on an "Apparatus And Method For Supporting A Cylindrical Tank"; and U.S. Pat. No. 5,833,195 patented Nov. 10, 1998 to D. Haynes and assigned to The United States of America as represented by the Secretary of the Army on a "Gas Retaining Device.

SUMMARY OF THE INVENTION

The present invention provides a mounting bracket for detachably supporting a generally cylindrically-shaped member upon a wall surface which would normally be vertically extending. It includes a backing plate member secured to this wall surface as well as one or more individual clamping members each extending outwardly from the backing plate member and away therefrom. The two clamping members define together preferably a C-shaped configuration to facilitate receiving and retaining of the cylindrically-shaped member therebetween. Each clamping member preferably is spatially disposed vertically from one another to facilitate retaining the cylindrically-shaped members when more than one individual clamping member is utilized. Each of the clamping members is of the same general configuration wherein it includes a clamp base detachably secured to the backing plate member in order to aid in retaining of the clamping member securely with respect to the backing plate member and to allow adjustment in the positioning of the clamp base with respect to the backing plate member. A first clamp arm is preferably secured to and extending upwardly from the clamp base and is preferably of a flexibly resilient material such as to facilitate engaging of the cylindrical member to aid in retaining thereof. This first clamp arm preferably defines a first adjustment aperture therein to facilitate adjustable positioning thereof. The first clamp arm preferably defines an adjustment abutment surface thereon which is preferably concave and has a radius of curvature identified as the adjustment radius of curvature.

A second clamp arm is secured to and extends outwardly from the clamp base at a position spatially disposed from the first clamp arm laterally therefrom. This second clamp arm is also preferably of a resiliently flexible material and is adapted to engage the cylindrical member oppositely from the position of the first clamp arm in order to facilitate retaining thereof selectively. The first clamp arm means, the second clamp arm means and the clamp base preferably together form a generally C-shaped configuration which defines a cylindrical gripping zone therebetween to facilitate retaining of items placed therebetween. Preferably these three members, that is, the first clamp arm, second clamp arm and the clamp base are all a single integrally formed member. The first clamp arm and the second clamp arm are preferably formed of a flexibly resilient material to facilitate separating thereof and aid in allowing of the cylindrically-shaped member to be moved into the cylinder gripping zone and retained therewithin. The second clamp arm preferably defines a second adjustment aperture therein to facilitate adjustment of the clamp arm adjustment device.

The clamp arm adjustment apparatus is attached to the first and second clamp arm means and extends therebetween. It is attached to the first and second clamp arms at a position between the clamp base and the cylinder gripping zone in such a manner as to aid in adjusting of the sizing of the cylinder gripping zone defined therebetween. This clamp arm adjusting means preferably further includes a main rod member attached to the second clamp arm which extend toward the first clamp arm. The main rod member is positioned extending through the first adjustment aperture defined in the first clamp arm. The main rod includes a retaining head mounted thereon adjacent the second adjustment aperture on the second clamp arm opposite from the first clamp arm. The retaining head member is preferably of a size larger than the second adjustment aperture means to prevent the retaining head member from passing therethrough. The main rod also preferably defines rod thread means thereon.

A locking member is also preferably included which is adjustably secured to the main rod member adjacent the first clamp arm opposite from the second clamp arm to limit spatial separation between the clamp arms. The locking member is preferably adjustably positionable with respect to the main rod to facilitate adjustment of the spacing between the first clamp arm and the second clamp arm in order to facilitate control and adjustment of the size of the cylinder gripping zone. The locking member is preferably larger than the first adjustment aperture in order to prevent it from passing therethrough. The locking member also defines locking threads thereon which are engageable with respect to the rod thread means for selectively securing of the locking member adjustably with respect to the main rod.

A spacer member is also preferably includes which is attached to the main rod and positioned in abutment with and between the locking member and the first clamp arm. The spacer member is larger than the first adjustment aperture in order to prevent passing therethrough. The spacer member also includes an arcuate abutment surface positioned in abutting contact with respect to the first clamp arm at a position oppositely with respect to the second clamp arm to maintain direct contact with the first clamp arm regardless of the positioning of the adjustment of the first clamp arm means with respect to the second clamp arm means or regardless of the positioning of them with respect to one another when a cylindrical item is held therebetween. The arcuate abutment surface is positioned to be in abutting contact with respect to the adjustment abutment surface of the first clamp arm means to facilitate direct contact therebetween at all times. The arcuate abutment surface is of a convex configuration in order to facilitate maintaining of contact with the adjustment abutment surface regardless of positioning of the first clamp arm with respect to the second clamp arm. This adjustment abutment surface and the arcuate abutment surface are mated and in registration with one another in order to direct the restricted force exerted by the main rod restricting movement of the first clamp arm away from the second clamp arm to be approximately perpendicular to the contact surface of the first clamp arm regardless of the relative positioning of the main rod means with respect to the first clamp arm.

The arcuate abutment surface defines an arcuate radius of curvature which is preferably less than the adjustment radius of curvature to facilitate abutting engagement therebetween regardless of the position of the first clamp arm relative to the second clamp arm. A spacer member defines preferably a spacer hole extending therethrough which is larger than the main rod member to facilitate receiving thereof in order to maintain positioning of the spacer member between the locking member and the first clamp arm with the curved abutment surfaces in contact with respect to one another. A foot member may also be included secured to the backing plate member below the clamping member and the cylindrical gripping zone defined therebetween in order to facilitate supporting of the cylindrically-shaped member positioned within the cylinder gripping zone thereabove.

It is an object of the present invention to provide a mounting bracket means for detachably supporting a generally cylindrically-shaped member upon a wall surface wherein the number of moving parts is minimized.

It is an object of the present invention to provide a mounting bracket means for detachably supporting a generally cylindrically-shaped member upon a wall surface wherein maintenance requirements are minimized.

It is an object of the present invention to provide a mounting bracket means for detachably supporting a generally cylindrically-shaped member upon a wall surface wherein down time is minimized.

It is an object of the present invention to provide a mounting bracket means for detachably supporting a generally cylindrically-shaped member upon a wall surface wherein movement of various sized cylinders into the cylinder gripping zone is possible.

It is an object of the present invention to provide a mounting bracket means for detachably supporting a generally cylindrically-shaped member upon a wall surface wherein clamping members are included to define a C-shaped cylindrical member receiving area.

It is an object of the present invention to provide a mounting bracket means for detachably supporting a generally cylindrically-shaped member upon a wall surface wherein a backing plate member is securable with respect to a vertically extending wall surface to hold cylindrical members with respect thereto and spaced from the vertically extending wall surface.

It is an object of the present invention to provide a mounting bracket means for detachably supporting a generally cylindrically-shaped member upon a wall surface wherein an extremely accurate adjustment means is included for varying the size of the cylinder gripping zone.

It is an object of the present invention to provide a mounting bracket means for detachably supporting a generally cylindrically-shaped member upon a wall surface wherein the clamping members are formed of a flexibly resilient material to facilitate movement of a cylindrical member between the clamping members and to facilitate removal therefrom as well as retaining while being maintained therebetween.

It is an object of the present invention to provide a mounting bracket means for detachably supporting a generally cylindrically-shaped member upon a wall surface wherein an adjustment means is provided between the C-shaped clamping arms and the clamp base to facilitate overall accurate adjustment in the positioning of the clamp arms with respect to one another for a specifically desired application.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
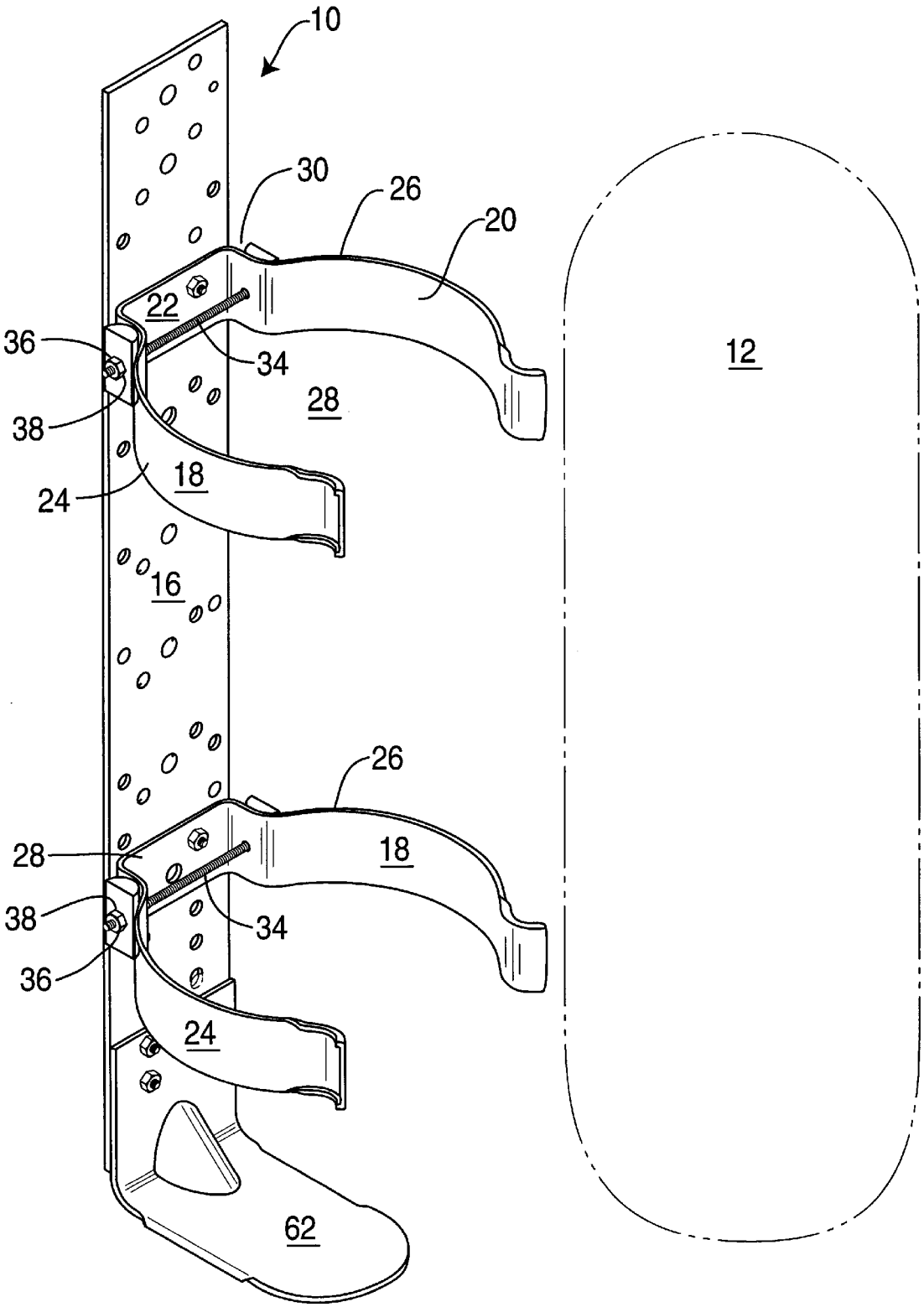
FIG. 1 is a perspective illustration of an embodiment of the mounting bracket of the present invention for detachably supporting a generally cylindrically-shaped member upon a wall surface.
Figure 2:
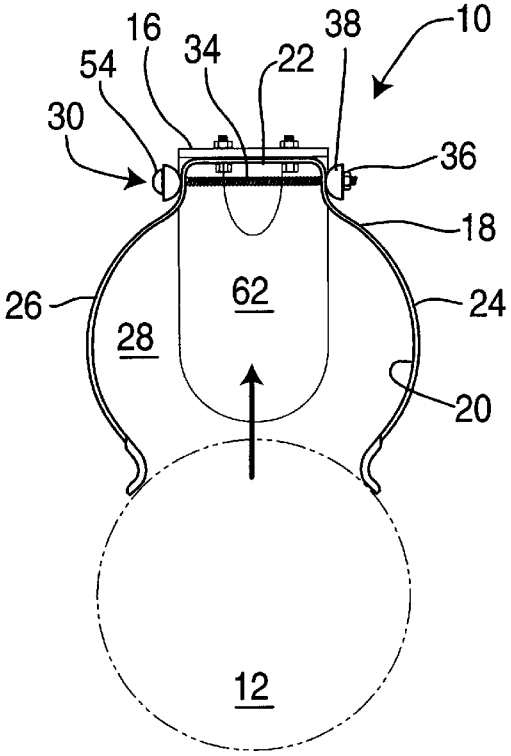
FIG. 2 is a top plan view of the embodiment shown in FIG. 1 illustrating the cylindrically-shaped member being moved toward the bracket.
Figure 3:
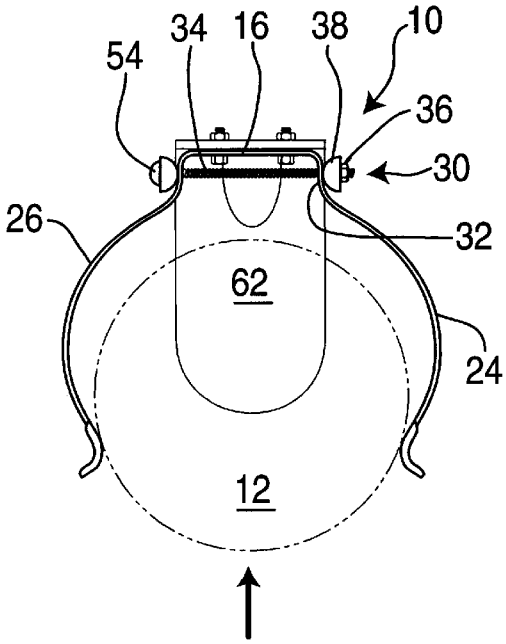
FIG. 3 is a top plan view of the embodiment shown in FIG. 1 illustrating the cylindrically-shaped member being positioned finally between the two clamp arms.
Figure 4:
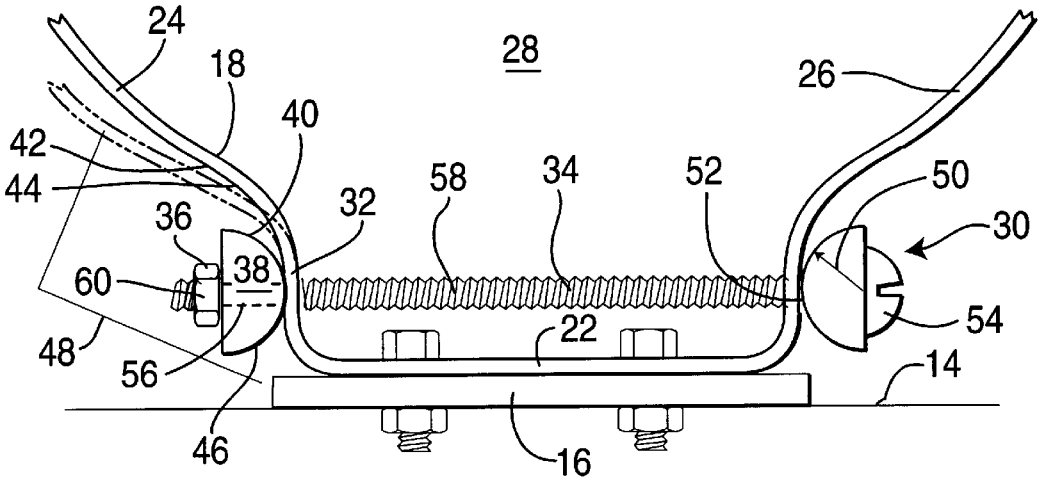
FIG. 4 is an exploded top plan view of an embodiment the clamp arm adjustment means of the present invention.

The present invention provides a mounting bracket designed to detachably support a generally cylindrically shaped member upon a vertical surface such as a wall surface. The wall surface 14 is designed to receive the mounting bracket 10 secured thereto such as to hold a cylindrical member 12 generally spaced from the wall surface to facilitate prompt access thereto. Such units are commonly used in the emergency field such as fire trucks wherein cylindrical members such as oxygen tanks are secured by a mounting bracket 10 with respect to a vertically extending surface on the side of a fire truck or other emergency vehicle.

The mounting bracket 10 includes a backing plate member 16 which itself is secured with respect to the wall surface 14 in a generally vertical orientation. A clamping member 18 is secured to the backing plate member 16 and is designed to define a cylindrical gripping zone 28 for receiving and selectively holding a cylindrical member 12 detachably therewithin.

Preferably the clamping member 18 includes a clamp base 22 which is designed to be secured directly to the backing plate member 16. A first clamp arm 24 is also preferably secured to the clamp base 22 such as to extend approximately horizontally outwardly therefrom. A second clamp arm 26 is also secured to the clamp base 22 in such a manner as to extend approximately horizontally outwardly therefrom at a position in spaced relation from the first clamp arm means 24. Preferably the clamp base 22, the first clamp arm 24 and the second clamp arm 26 define a C-shaped cylindrical grasping surface 20.

The size of the C-shaped grasping surface 20 and therefore the size of the cylindrical gripping zone 28 must be carefully controlled in order to accommodate various sized cylindrical members 12. For this reason a clamp arm adjustment means 30 is included.

Preferably clamp arm adjustment apparatus 30 includes a first adjustment aperture 32 defined in the first clamp arm 24. A main rod member 34 preferably is smaller in diameter than the first adjustment aperture 32 such that it is capable of extending therethrough. Preferably the main rod member 34 is attached with respect to the second clamp arm 26 and extends through the first adjustment aperture 32 of the first clamp arm 24 such as to be adjustably locked thereto. For this purpose a locking member 36 is included such as a nut which is detachably lockable with respect to the main rod member 34. A spacer member 38 is preferably positioned between the locking member 36 and the first clamp arm 24 to maintain direct abutment therebetween regardless of the positioning of the first clamp arm 24 and the second clamp arm 26.

Preferably the spacer member 38 includes an arcuate abutment surface 40 which is mated to an adjustment abutment surface 42 of the first clamp arm means 24. This mating engagement preferably is defined such that the first clamp arm 24 defines the adjustment abutment surface 42 to have a concave surface 44. At the same time the spacer member 38 defines an arcuate abutment surface 40 having a convex abutment surface 46. With concave surface 44 in direct engagement with respect to convex surface 46 continuous abutment of them with respect to one another will be achieved regardless of movement or relative positioning of the first clamp arm 24 with respect to the second clamp arm 26 for the purposes of adjustment of the spacing of the cylindrical gripping zone 28 or during placement or removal of the cylindrical member 12 thereinto.

To further enhance mating engagement between the concave surface 44 of first clamp arm 24 and the convex surface 46 of spacer member 38 the radius of curvature of these two surfaces is carefully chosen. In particular the adjustment radius curvature 48 of the first clamp arm 24 is defined to be greater in length than the arcuate radius of curvature 50 defined on the convex surface 46 of the spacer member 38. This relative orientation will maintain contact between these parts regardless of the positioning or movement of the first and second clamp arms 24 and 26 with respect to one another during adjustment or during placement or removal of a cylindrical member 12 relative to the cylindrical gripping zone 28.

In a further preferred configuration the second clamp arm 26 will define a second adjustment aperture 52 which is larger than the main rod member 34. Main rod member 34 will then extend through the second adjustment aperture 52 at a position spatially disposed from the first adjustment aperture 32. Main rod member 34 will include a retaining head member 54 which is larger in diameter than the second adjustment aperture 52 to prevent movement of the head member 54 through the second adjustment aperture 52. With this configuration the movement of the first clamp arm 24 and the second clamp arm 26 away from one another will be controlled. In particular movement of the second clamp arm 26 away from the first clamp are 24 will be controlled by the retaining head member 54 and the possible positioning of the spacer member 38 between that retaining head and the second adjustment aperture 52. This construction simultaneously with the locking member 36 will achieve restriction in the outward movement of the clamp members with respect to one another. Since locking member 36 and spacer member 38 cannot pass through the first adjustment aperture 32 this member in combination with the retaining head member 54 will restrict the maximum size of the cylindrical gripping zone 28 which size, however, will be adjustable by repositioning of the locking member 36 with respect to the main rod member 34 if deemed necessary.

Positioning of the spacer member 38 with respect to the main rod 34 is facilitated by the defining of a spacer hole 56 extending therethrough such that it extends through the convex surface 46 defined thereon. The spacer hole 56 is larger than the main rod member 34 and is adapted to receive that rod member 34 extending therethrough. In this manner the spacer hole 56 will be retained adjacent to the main rod member 34 between the locking member 36 and the first clamp arm 24.

To facilitate engagement between the main rod member 34 and the locking member 36 the main rod member will preferably define rod threads 58 thereon. Similarly the locking member 36 will preferably define locking thread means 60 thereon. Preferably the rod 58 threads will be male on the external surface of the main rod member 34 and the locking threads 60 will be female on the interior of the locking member or nut 36. Engagement between the rod threads 58 and the locking threads 60 will facilitate adjustment in the relative positioning of the locking member 36 with respect to the main rod member 34.

To further facilitate holding of a cylindrical member 12 within the cylinder gripping zone 28 a foot member 62 may be included immediately therebelow. In this manner the weight of the cylindrical member 12 can be supported on the foot member 62 while the upper cylindrical side surfaces of the cylindrical member 12 is gripped by the first and second clamp arms 24 and 26 to selectively retain the cylindrical member within the cylinder gripping zone 28.

In the preferred configuration of the present invention two such clamping members will be included each extending outwardly away from the backing plate member and being generally C-shaped and spaced vertically from one another. Each of these clamping members will include a clamp base along with a first clamp arm and a second clamp arm to facilitate the holding of a cylindrical object therein by positioning one clamping member in the upper portion thereof and the other clamping member in the lower portion thereof.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A mounting bracket means for detachably supporting a generally cylindrically-shaped member upon a wall surface comprising:

A. a backing plate member securable to a wall surface;

B. at least one clamping member extending outwardly away from said backing plate member and being generally C-shaped to facilitate receiving and retaining of a generally cylindrically-shaped member therein, each of said clamping members including:

(1) a clamp base means securable to said backing plate member to facilitate retaining of said clamping member securely with respect to said backing plate member;

(2) a first clamp arm means secured to and extending outwardly from said clamp base means and being resiliently flexible and adapted to engage the cylindrically-shaped member to facilitate retaining thereof selectively;

(3) a second clamp arm means secured to and extending outwardly from said clamp base means at a position spatially disposed from said first clamp arm means, said second clamp arm means being resiliently flexible and adapted to engage the cylindrically-shaped member oppositely from said first clamp arm means to facilitate retaining thereof selectively, said first clamp arm means, said second clamp arm means and said clamp base means together forming a generally C-shaped configuration defining a cylinder gripping zone therebetween to facilitate retaining of a cylindrically-shaped member placed therebetween; and (4) a clamp arm adjustment means attached to said first and second clamp arm means and extending therebetween, said clamp arm adjustment means being attached to said first and second clamp arm means at a position between said clamp base means and said cylinder gripping zone to facilitate adjustment in sizing of said cylinder gripping zone defined therebetween, said clamp arm adjustment means comprising:

a. a main rod member attached to said second clamp arm means and extending toward said first clamp arm means, said main rod member positioned extending through said first adjustment aperture means defined in said first clamp arm means;

b. a locking member adjustably secured to said main rod member adjacent said first clamp arm means oppositely from said second clamp arm means to limit spatial separation between said first clamp arm means and said second clamp arm means, said locking member being adjustably positionable with respect to said main rod member to facilitate adjustment of the spacing between said first clamp arm means and said second clamp arm means to facilitate control of sizing of said cylinder gripping zone; and c. a spacer member attached to said main rod member and positioned in abutment with and between said locking member and said first clamp arm means, said spacer member including an arcuate abutment surface positioned in abutting contact with respect to said first clamp arm means at a position oppositely with respect to said second clamp arm means to maintain direct contact with said first clamp arm means regardless of the position of adjustment of said first clamp arm means with respect to said second clamp arm means.

2. A mounting bracket means for detachably supporting a generally cylindrically-shaped member upon a wall surface as defined in claim 1 wherein said backing plate member is oriented extending vertically by being secured to a vertically extending wall surface.

3. A mounting bracket means for detachably supporting a generally cylindrically-shaped member upon a wall surface as defined in claim 1 wherein said first clamp arm means defines an adjustment abutment surface thereon positioned to be in abutting contact with respect to said arcuate abutment surface of said spacer member to facilitate direct contact therebetween despite relative positioning of said first clamp arm means to said second clamp arm means.

4. A mounting bracket means for detachably supporting a generally cylindrically-shaped member upon a wall surface as defined in claim 3 wherein said adjustment abutment surface is concave and said arcuate abutment surface is convex to facilitate maintaining of contact therebetween regardless of positioning of said first clamp arm means relative to said second clamp arm means.

5. A mounting bracket means for detachably supporting a generally cylindrically-shaped member upon a wall surface as defined in claim 4 wherein said adjustment abutment surface and said arcuate abutment surface are mated and in registration with one another in order to direct the restrictive force exerted by said main rod means restricting movement of said first clamp arm means away from said second clamp arm means to be approximately perpendicular to the contact surface of said first clamp arm means regardless of the relative positioning of said main rod means with respect to said first clamp arm means.

6. A mounting bracket means for detachably supporting a generally cylindrically-shaped member upon a wall surface as defined in claim 5 wherein said adjustment abutment surface defines an adjustment radius of curvature and wherein said arcuate abutment surface defines an arcuate radius of curvature less than said adjustment radius of curvature to facilitate abutting engagement therebetween regardless of the positions of said first clamp arm means relative to said second clamp arm means.

7. A mounting bracket means for detachably supporting a generally cylindrically-shaped member upon a wall surface as defined in claim 1 wherein said locking member and said spacer member are larger than said first adjustment aperture means to prevent passing of said locking member and said spacer member therethrough.

8. A mounting bracket means for detachably supporting a generally cylindrically-shaped member upon a wall surface as defined in claim 1 wherein said second clamp arm means further defines a second adjustment aperture means therein to facilitate adjustment of said clamp arm adjustment means.

9. A mounting bracket means for detachably supporting a generally cylindrically-shaped member upon a wall surface as defined in claim 8 wherein said main rod means includes a retaining head member mounted thereon adjacent said second adjustment aperture means on said second clamp arm means opposite from said first clamp arm means.

10. A mounting bracket means for detachably supporting a generally cylindrically-shaped member upon a wall surface as defined in claim 9 wherein said retaining head member is larger than said second adjustment aperture means to prevent said retaining head member of said main rod means from passing therethrough.

11. A mounting bracket means for detachably supporting a generally cylindrically-shaped member upon a wall surface as defined in claim 1 wherein said first clamp arm means, said second clamp arm means and said clamp base means are integrally formed.

12. A mounting bracket means for detachably supporting a generally cylindrically-shaped member upon a wall surface as defined in claim 1 wherein said first clamp arm means and said second clamp arm means are formed of a flexibly resilient material to facilitate separating thereof to facilitate entry of a cylindrically-shaped member into said cylinder gripping zone and to facilitate retaining thereof within said cylinder gripping zone.

13. A mounting bracket means for detachably supporting a generally cylindrically-shaped member upon a wall surface as defined in claim 1 wherein said spacer member defines a spacer hole means extending therethrough which is larger than said main rod member, said spacer hole means adapted to receive said main rod member extending therethrough to maintain positioning of said spacer member between said locking member and said first clamp arm means.

14. A mounting bracket means for detachably supporting a generally cylindrically-shaped member upon a wall surface as defined in claim 1 wherein said main rod member defines rod thread means thereon and wherein said locking member defines locking thread means thereon, said locking thread means being engageable with respect to said rod thread means for selectively securing of said locking member adjustably with respect to said main rod member.

15. A mounting bracket means for detachably supporting a generally cylindrically-shaped member upon a wall surface as define din claim 1 further comprising two of said clamping members which cooperate to define a single of said cylinder gripping means therebetween.

16. A mounting bracket means for detachably supporting a generally cylindrically-shaped member upon a wall surface as defined in claim 1 wherein said clamp base means is detachably securable to said backing plate to provide adjustment in the relative positioning therebetween.

17. A mounting bracket means for detachably supporting a generally cylindrically-shaped member upon a wall surface as defined in claim 1 further comprising a foot member secured to said backing plate member below said clamping member and said cylinder gripping zone defined therebetween to facilitate supporting of a cylindrically-shaped member positioned therein.

18. A mounting bracket means for detachably supporting a generally cylindrically-shaped member upon a wall surface comprising:

A. a backing plate member securable to a wall surface;

B. at least two clamping members each extending outwardly away from said backing plate member and being generally C-shaped to facilitate receiving and retaining of a generally cylindrically-shaped member therein, said clamping member being spatially disposed vertically from one another to facilitate retaining of cylindrically-shaped members therebetween, each of said clamping members including:

(1) a clamp base means detachably securable to said backing plate member to facilitate retaining of said clamping member securely with respect to said backing plate member and to allow adjustment in the positioning of said clamp base means with respect to said backing plate member;

(2) a first clamp arm means secured to and extending outwardly from said clamp base means and being resiliently flexible and adapted to engage the cylindrically-shaped member to facilitate retaining thereof selectively, said first clamp arm means defining a first adjustment aperture means therein to facilitate adjustable positioning thereof, said first clamp arm means defining an adjustment abutment surface thereon, said adjustment abutment surface being concave, said adjustment abutment surface defining an adjustment radius of curvature;

(3) a second clamp arm means secured to and extending outwardly from said clamp base means at a position spatially disposed from said first clamp arm means, said second clamp arm means being resiliently flexible and adapted to engage the cylindrically-shaped member oppositely from said first clamp arm means to facilitate retaining thereof selectively, said first clamp arm means, said second clamp arm means and said clamp base means together forming a generally C-shaped configuration defining a cylinder gripping zone therebetween to facilitate retaining of a cylindrically-shaped member placed therebetween, said first clamp arm means, said second clamp arm means and said clamp base means being integrally formed, said first clamp arm means and said second clamp arm means being formed of a flexibly resilient material to facilitate separating thereof to facilitate entry of a cylindrically-shaped member into said cylinder gripping zone and to facilitate retaining thereof within said cylinder gripping zone, said second clamp arm means further defining a second adjustment aperture means therein to facilitate adjustment thereof;

(4) a clamp arm adjustment means attached to said first and second clamp arm means and extending therebetween, said clamp arm adjustment means being attached to said first and second clamp arm means at a position between said clamp base means and said cylinder gripping zone to facilitate adjustment in sizing of said cylinder gripping zone defined therebetween, said clamp arm adjustment means further comprising:

(a) a main rod member attached to said second clamp arm means and extending toward said first clamp arm means, said main rod member positioned extending through said first adjustment aperture means defined in said first clamp arm means, said main rod means includes a retaining head member mounted thereon adjacent said second adjustment aperture means on said second clamp arm means opposite from said first clamp arm means, said retaining head member being larger than said second adjustment aperture means to prevent said retaining head member of said main rod means from passing therethrough, said main rod member defining a rod thread means thereon;

(b) a locking member adjustably secured to said main rod member adjacent said first clamp arm means oppositely from said second clamp arm means to limit spatial separation between said first clamp arm means and said second clamp arm means, said locking member being adjustably positionable with respect to said main rod member to facilitate adjustment of the spacing between said first clamp arm means and said second clamp arm means to facilitate control of sizing of said cylinder gripping zone, said locking member being larger than said first adjustment aperture means to prevent passing therethrough, said locking member defining locking thread means thereon being engageable with respect to said rod thread means for selectively securing of said locking member adjustably with respect to said main rod member;

(c) a spacer member attached to said main rod member and positioned in abutment with and between said locking member and said first clamp arm means, said spacer member being larger than said first adjustment aperture means to prevent passing therethrough, said spacer member including an arcuate abutment surface positioned in abutting contact with respect to said first clamp arm means at a position oppositely with respect to said second clamp arm means to maintain direct contact with said first clamp arm means regardless of the position of adjustment of said first clamp arm means with respect to said second clamp arm means, said arcuate abutment surface being positioned to be in abutting contact with respect to said adjustment abutment surface of said first clamp arm means to facilitate direct contact therebetween despite adjustable positioning of said first clamp arm means to said second clamp arm means, said arcuate abutment surface being convex to facilitate maintaining of contact with said adjustment abutment surface regardless of positioning of said first clamp arm means relative to said second clamp arm means, said adjustment abutment surface and said arcuate abutment surface being mated and in registration with one another in order to direct the restrictive force exerted by said main rod means restricting movement of said first clamp arm means away from said second clamp arm means to be approximately perpendicular to the contact surface of said first clamp arm means regardless of the relative positioning of said main rod means with respect to said first clamp arm means, said arcuate abutment surface defining an arcuate radius of curvature less than said adjustment radius of curvature to facilitate abutting engagement therebetween regardless of the position of said first clamp arm means relative to the position of said second clamp arm means, said spacer member defining a spacer hole means extending therethrough which is larger than said main rod member, said spacer hole means adapted to receive said main rod member extending therethrough to maintain positioning of said spacer member between said locking member and said first clamp arm means; and C. a foot member secured to said backing plate member below said clamping member and said cylinder gripping zone defined therebetween to facilitate supporting of a cylindrically-shaped member positioned therein.

19. A mounting bracket means for detachably supporting a generally cylindrically-shaped member upon a wall surface comprising:

A. a backing plate member securable to a wall surface;

B. at least one clamping member extending outwardly away from said backing plate member and being generally C-shaped to facilitate receiving and retaining of a generally cylindrically-shaped member therein, each of said clamping members including:

(1) a clamp base means securable to said backing plate member to facilitate retaining of said clamping member securely with respect to said backing plate member;

(2) a first clamp arm means secured to and extending outwardly from said clamp base means and being resiliently flexible and adapted to engage the cylindrically-shaped member to facilitate retaining thereof selectively, said first clamp arm means defining a first adjustment aperture means therein to facilitate adjustable positioning thereof, said first clamp arm means defining an adjustment abutment surface thereon, said adjustment abutment surface being concave;

(3) a second clamp arm means secured to and extending outwardly from said clamp base means at a position spatially disposed from said first clamp arm means, said second clamp arm means being resiliently flexible and adapted to engage the cylindrically-shaped member oppositely from said first clamp arm means to facilitate retaining thereof selectively, said first clamp arm means, said second clamp arm means and said clamp base means together forming a generally C-shaped configuration defining a cylinder gripping zone therebetween to facilitate retaining of a cylindrically-shaped member placed therebetween, said first clamp arm means, said second clamp arm means and said clamp base means being integrally formed, said first clamp arm means and said second clamp arm means being formed of a flexibly resilient material to facilitate separating thereof to facilitate entry of a cylindrically-shaped member into said cylinder gripping zone and to facilitate retaining thereof within said cylinder gripping zone; and (4) a clamp arm adjustment means attached to said first and second clamp arm means and extending therebetween, said clamp arm adjustment means being attached to said first and second clamp arm means at a position between said clamp base means and said cylinder gripping zone to facilitate adjustment in sizing of said cylinder gripping zone defined therebetween, said clamp arm adjustment means further comprising:

(a) a main rod member attached to said second clamp arm means and extending toward said first clamp arm means, said main rod member positioned extending through said first adjustment aperture means defined in said first clamp arm means;

(b) a locking member adjustably secured to said main rod member adjacent said first clamp arm means oppositely from said second clamp arm means to limit spatial separation between said first clamp arm means and said second clamp arm means, said locking member being adjustably positionable with respect to said main rod member to facilitate adjustment of the spacing between said first clamp arm means and said second clamp arm means to facilitate control of sizing of said cylinder gripping zone; and (c) a spacer member attached to said main rod member and positioned in abutment with and between said locking member and said first clamp arm means, said spacer member including an arcuate abutment surface positioned in abutting contact with respect to said first clamp arm means at a position oppositely with respect to said second clamp arm means to maintain direct contact with said first clamp arm means regardless of the position of adjustment of said first clamp arm means with respect to said second clamp arm means, said arcuate abutment surface being positioned to be in abutting contact with respect to said adjustment abutment surface of said first clamp arm means to facilitate direct contact therebetween despite adjustable positioning of said first clamp arm means to said second clamp arm means, said arcuate abutment surface being convex to facilitate maintaining of contact with said adjustment abutment surface regardless of positioning of said first clamp arm means relative to said second clamp arm means, said adjustment abutment surface and said arcuate abutment surface being mated and in registration with one another in order to direct the restrictive force exerted by said main rod means restricting movement of said first clamp arm means away from said second clamp arm means to be approximately perpendicular to the contact surface of said first clamp arm means regardless of the relative positioning of said main rod means with respect to said first clamp arm means.

* * * * *